US010332536B2

(12) United States Patent
Niedermeier et al.

(10) Patent No.: US 10,332,536 B2
(45) **Date of Patent: *Jun. 25, 2019**

(54) APPARATUS AND METHOD FOR DECODING AN ENCODED AUDIO SIGNAL WITH LOW COMPUTATIONAL RESOURCES

(71) Applicant: Fraunhofer-Gesellschaft zur Foerderung der angewandten Forschung e.V., Munich (DE)

(72) Inventors: Andreas Niedermeier, Munich (DE); Stephan Wilde, Nuremberg (DE); Daniel Fischer, Fuerth (DE); Matthias Hildenbrand, Erlangen (DE); Marc Gayer, Erlangen (DE); Max Neuendorf, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.
This patent is subject to a terminal disclaimer.

(21) Appl. No.: 15/621,938

(22) Filed: Jun. 13, 2017

(65) Prior Publication Data

US 2017/0278522 A1 Sep. 28, 2017

Related U.S. Application Data

(63) Continuation of application No. 15/177,265, filed on Jun. 8, 2016, now Pat. No. 9,799,345, which is a (Continued)

(30) Foreign Application Priority Data

Dec. 9, 2013 (EP) ..... 13196305

(51) Int. Cl.
*G10L 19/20* (2013.01)
*G10L 19/22* (2013.01)
(Continued)

(52) U.S. Cl.
CPC ..... *G10L 19/22* (2013.01); *G10L 19/008* (2013.01); *G10L 19/022* (2013.01);
(Continued)

(58) Field of Classification Search
None
See application file for complete search history.

(56) References Cited

U.S. PATENT DOCUMENTS

2002/0143527 A1 10/2002 Gao et al.
2011/0216918 A1 9/2011 Nagel et al.
(Continued)

FOREIGN PATENT DOCUMENTS

EP 2169670 A2 3/2010
JP 2011520146 A 7/2011
RU 2011109670 A 9/2012

OTHER PUBLICATIONS

Song J et al.; Enhanced Long-Term Predictor for Unified Speech and Audio Coding; 2011 IEEE International Conference on Acoustics, Speech and Signal Processing (ICASSP); Year 2011, pp. 504-508.*

(Continued)

*Primary Examiner* — Abul K Azad
(74) *Attorney, Agent, or Firm* — Perkins Coie LLP; Michael A. Glenn

(57) ABSTRACT

An apparatus for decoding an encoded audio signal including bandwidth extension control data indicating either a first harmonic bandwidth extension mode or a second non-harmonic bandwidth extension mode, includes: an input interface for receiving the encoded audio signal including the bandwidth extension control data indicating either the first harmonic bandwidth extension mode or the second non-harmonic bandwidth extension mode; a processor for decoding the audio signal using the second non-harmonic bandwidth extension mode; and a controller for controlling the processor to decode the audio signal using the second non-harmonic bandwidth extension mode, even when the
(Continued)

bandwidth extension control data indicates the first harmonic bandwidth extension mode for the encoded signal.

8 Claims, 15 Drawing Sheets

Related U.S. Application Data continuation of application No. PCT/EP2014/076000, filed on Nov. 28, 2014.

(51) Int. Cl.

| | |
|---|---|
| ***G10L 19/008*** | (2013.01) |
| ***G10L 19/24*** | (2013.01) |
| ***G10L 21/038*** | (2013.01) |
| ***G10L 19/022*** | (2013.01) |
| ***G10L 19/16*** | (2013.01) |

(52) U.S. Cl.

CPC ..... *G10L 19/167* (2013.01); *G10L 19/20* (2013.01); *G10L 19/24* (2013.01); *G10L 21/038* (2013.01)

(56) References Cited

U.S. PATENT DOCUMENTS

2012/0010880 A1* 1/2012 Nagel ..... G10L 19/18 704/205
2012/0158409 A1 6/2012 Nagel et al.
2013/0090934 A1 4/2013 Nagel et al.

OTHER PUBLICATIONS

"Study on ISO/IEC 23003-3:201x/DIS of Unified Speech and Audio Coding", ISO/IEC JTC1/SC29/WG11 N12013; Coding of Moving Pictures and Audio; International Organisation for Standardisation; Geneva, Switzerland, Mar. 2011, 274 pages.

ISO/IEC FDIS 23003-3:2011(E); "Information technology—MPEG audio technologies—Part 3: Unified speech and audio coding", ISO/IEC JTC 1/SC 29/WG 11; STD Version 2.1c2, Sep. 20, 2011, 291 pages.

"USAC Verification Test Report", ISO/IEC JTC1/SC29/WG11 MPEG2011/N12232; Coding of Moving Pictures and Audio; Torino, Italy, Jul. 2011, pp. 1-41.

ISO/IEC 14496-3:2009(E), "Information technology—Coding of audio-visual objects, Part 3 Audio", International Standard, Forth edition, 2009, 1416 pages.

Liu, et al., "Blind bandwidth extension of audio signals based on harmonic mapping in phase space", IEEE, Feb. 2, 2013, pp. 454-458.

Nagel, F. et al., "A Continuous Modulated Single Sideband Bandwidth Extension", IEEE Intl Conf. on Acoustics, Speech and Signal Processing, Mar. 2010, pp. 257-360.

* cited by examiner

130

| harmonicSBR | sbrPatchingMode | USAC standard | novel decoder |
|---|---|---|---|
| 0 | X | non-harmonic | non-harmonic |
| 0 | X | non-harmonic | non-harmonic |
| 1 | 0 | harmonic | non-harmonic |
| 1 | 1 | non-harmonic | non-harmonic |

non-harmonic as defined in the HE-AAC standard

FIG 1C syntax of sbr_single_channel_element()

| Syntax | No. of bits | Mnemonic |
|---|---|---|
| sbr_single_channel_element(bs_amp_res, bs_pvc_mode, indepFlag) | | |
| { | | |
| if (harmonicSBR) { | | |
| if (sbrPatchingMode[0] ==0) { | 1 | uimsbf |
| 602 sbrOversamplingFlag[0]; | 1 | uimsbf |
| if (sbrPitchInBinsFlag[0]) | 1 | uimsbf |
| 604 sbrPitchInBins[0]; | 7 | uimsbf |
| Else | | |
| sbrPitchInBins[0] = 0; | | |
| } else { | | |
| sbrOversamplingFlag[0] = 0; | | |
| sbrPitchInBins[0] = 0; | | |
| } | | |
| if(IpHBE)sbrPatchingMode[0] = 1; | | |
| 600 } | | |
| sbr_grid(0, bs_pvc_mode); | | |
| sbr_dtdf(0, bs_pvc_mode, indepFlag); | | |
| sbr_invf(0); | | |
| if (bs_pvc_mode==0) { | | |
| sbr_envelope(0, 0, bs_amp_res); | | |
| } eise { | | |
| 606 pvc_envelope(indepFlag); | | |
| } | | |
| sbr_noise(0, 0); | | |
| if (bs_add_harmonic_flag[0]) { | 1 | uimsbf |
| sbr_sinusoidal_coding(0, bs_pvc_mode); | | |
| } | | |
| } | | |

FIG 6 syntax of sbr_channel_pair_element()

| Syntax | No. of bits | Mnemonic |
|---|---|---|
| sbr_channel_pair_element(bs_amp_res, indepFlag) | | |
| { | | |
| if (bs_coupling) { | 1 | uimsbf |
| if (harmonicSBR) { | | |
| if (sbrPatchingMode[0,1] == 0) { | 1 | uimsbf |
| sbrOversamplingFlag[0,1]; | 1 | uimsbf |
| if (sbrPitchInBinsFlag[0,1]) | 1 | uimsbf |
| sbrPitchInBins[0,1]; | 7 | uimsbf |
| else | | |
| sbrPitchInBins[0,1] = 0; | | |
| } else { | | |
| sbrOversamplingFlag[0,1] = 0; | | |
| sbrPitchInBins[0,1] = 0; | | |
| } | | |
| 700 → if(lpHBE)sbrPatchingMode[0,1] = 1; | | |
| } | | |
| sbr_grid(0, 0); | | |
| sbr_dtdf(0, 0, indepFlag); | | |
| sbr_dtdf(1, 0, indepFlag); | | |
| sbr_invf(0); | | |
| sbr_envelope(0,1, bs_amp_res); | | |
| sbr_noise(0,1); | | |
| sbr_envelope(1,1, bs_amp_res); | | |
| sbr_noise(1,1); | | |
| } else { | | |
| if (harmonicSBR) { | | |
| if (sbrPatchingMode[0] == 0) { | 1 | uimsbf |
| sbrOversamplingFlag[0]; | 1 | uimsbf |
| if (sbrPitchInBinsFlag[0]) | 1 | uimsbf |
| sbrPitchInBins[0]; | 7 | uimsbf |
| Else | | |
| sbrPitchInBins[0] = 0; | | |
| } else { | | |
| sbrOversamplingFlag[0] = 0; | | |
| sbrPitchInBins[0] = 0; | | |
| } | | |

CONTINUED IN FIG 7B

FIG 7A

CONTINUED FROM FIG 7A

```
702 ->  if(lpHBE)sbrPatchingMode[0] = 1;
        if (sbrPatchingMode[1] == 0) {                  1     uimsbf
            sbrOversamplingFlag[1];                     1     uimsbf
            if (sbrPitchInBinsFlag[1])                  1     uimsbf
                sbrPitchInBins[1];                      7     uimsbf
            Else
                sbrPitchInBins[1] = 0;
        } else {
            sbrOversamplingFlag[1] = 0;
            sbrPitchInBins[1] = 0;
        }
704 ->  if(lpHBE)sbrPatchingMode[1] = 1;
    }
    sbr_grid(0, 0);
    sbr_grid(1, 0);
    sbr_dtdf(0,0, indepFlag);
    sbr_dtdf(1,0, indepFlag);

    sbr_invf(0);
    sbr_invf(1);

    sbr_envelope(0,0, bs_amp_res);
    sbr_envelope(1,0, bs_amp_res);
    sbr_noise(0,0);
    sbr_noise(1,0);
}

if (bs_add_harmonic_flag[0]) {                          1     uimsbf
    sbr_sinusoidal_coding(0, 0);
}
if (bs_add_harmonic_flag[1]) {                          1     uimsbf
    sbr_sinusoidal_coding(1, 0);
}
}
```

FIG 7B

| | |
|---|---|
| harmonicGrid (hg) | harmonic grid according to (1) |
| source_band | QMF patch source band |
| dest_band | QMF patch destination band |
| p_mod_x | source_band mod hg |
| k_mod_x | dest_band mod hg |
| mod | modulo operation |
| NINT | round to nearest integer |
| sbrRatio | SBR rafio, i. e. $\frac{1}{2}$, $\frac{3}{8}$ or $\frac{1}{4}$ |
| pitchInBins | pitch information transmitted in the bitstream |

$$\text{harmonicGrid} = \text{NINT}\left(\left(\frac{64 * \text{sbrPitchInBins} * \text{sbrRatio}}{1536}\right)\right)$$

Formula (1)

FIG 8B

APPARATUS AND METHOD FOR DECODING AN ENCODED AUDIO SIGNAL WITH LOW COMPUTATIONAL RESOURCES

CROSS-REFERENCE TO RELATED APPLICATIONS

This application is a continuation of U. S. patent application Ser. No. 15/177,265, filed Jun. 8, 2016, which is a continuation of International Application No. PCT/EP2014/076000, filed Nov. 28, 2014, which is incorporated herein by reference in its entirety, and additionally claims priority from European Application No. EP 13196305.0, filed Dec. 9, 2013, which is incorporated herein by reference in its entirety.

BACKGROUND OF THE INVENTION

The present invention is related to audio processing and in particular to a concept for decoding an encoded audio signal using reduced computational resources.

The "Unified speech and audio coding" (USAC) standard [1], standardizes a harmonic bandwidth extension tool, HBE, employing a harmonic transposer, and which is an extension of the spectral band replication (SBR) system, standardized in [1] and [2], respectively.

SBR synthesizes high frequency content of bandwidth limited audio signals by using the given low frequency part together with given side information. The SBR tool is described in [2], enhanced SBR, eSBR, is described in [1]. The harmonic bandwidth extension HBE which employs phase vocoders is part of eSBR and has been developed to avoid the auditory roughness which is often observed in signals subjected to copy-up patching, as it is carried out in the regular SBR processing. The main scope of HBE is to preserve harmonic structures in the synthesized high frequency region of the given audio signal while applying eSBR.

Whereas an encoder can select the usage of the HBE tool, a decoder which is conform to [1] shall provide decoding and applying HBE related data.

Listening tests [3] have shown that using HBE will improve perceptual audio quality of decoded bitstreams according to [1].

The HBE tool replaces the simple copy-up patching of the legacy SBR system by advanced signal processing routines. These necessitate a considerable amount of processing power and memory for filter states and delay lines. On the contrary the complexity of the copy-up patching is negligible.

The observed complexity increase with HBE is not a problem for personal computer devices. However, chip manufactures designing decoder chips are demanding rigid and low complexity constraints regarding computational workload and memory consumption. Otherwise, HBE processing is desired in order to avoid auditory roughness.

USAC-bitstreams are decoded as described in [1]. This implies necessarily the implementation of a HBE decoder tool, as described in [1], 7.5.3. The tool can be signaled in all codec operating points which contain eSBR processing. For decoder devices which fulfill profile and conformance criteria of [1] this means that the overall worst case of computational workload and memory consumption increases significantly.

The actual increase in computational complexity is implementation and platform dependent. The increase in memory consumption per audio channel is, in the current memory optimized implementation, at least 15 kWords for the actual HBE processing.

SUMMARY

According to an embodiment, an apparatus for decoding an encoded audio signal having bandwidth extension control data indicating either a first harmonic bandwidth extension mode or a second non-harmonic bandwidth extension mode may have: an input interface for receiving the encoded audio signal having the bandwidth extension control data indicating either the first harmonic bandwidth extension mode or the second non-harmonic bandwidth extension mode; a processor for decoding the audio signal using the second non-harmonic bandwidth extension mode; and a controller for controlling the processor to decode the audio signal using the second non-harmonic bandwidth extension mode, even when the bandwidth extension control data indicates the first harmonic bandwidth extension mode for the encoded signal.

According to an embodiment, a method of decoding an encoded audio signal having bandwidth extension control data indicating either a first harmonic bandwidth extension mode or a second non-harmonic bandwidth extension mode may have the steps of: receiving the encoded audio signal having the bandwidth extension control data indicating either the first harmonic bandwidth extension mode or the second non-harmonic bandwidth extension mode; decoding the audio signal using the second non-harmonic bandwidth extension mode; controlling the decoding of the audio signal so that the second non-harmonic bandwidth extension mode is used in the decoding, even when the bandwidth extension control data indicates the first harmonic bandwidth extension mode for the encoded signal.

An embodiment may have a non-transitory digital storage medium having a computer program stored thereon to perform the method of decoding an encoded audio signal having bandwidth extension control data indicating either a first harmonic bandwidth extension mode or a second non-harmonic bandwidth extension mode, having the steps of: receiving the encoded audio signal having the bandwidth extension control data indicating either the first harmonic bandwidth extension mode or the second non-harmonic bandwidth extension mode; decoding the audio signal using the second non-harmonic bandwidth extension mode; and controlling the decoding of the audio signal so that the second non-harmonic bandwidth extension mode is used in the decoding, even when the bandwidth extension control data indicates the first harmonic bandwidth extension mode for the encoded signal, when said computer program is run by a computer.

The present invention is based on the finding that an audio decoding concept necessitating reduced memory resources is achieved when an audio signal consisting of portions to be decoded using an harmonic bandwidth extension mode and additionally containing portions to be decoded using a non-harmonic bandwidth extension mode is decoded, throughout the whole signal, with the non-harmonic bandwidth extension mode only. In other words, even when a signal comprises portions or frames which are signaled to be decoded using a harmonic bandwidth extension mode, these portions or frames are nevertheless decoded using the non-harmonic bandwidth extension mode. To this end, a processor for decoding the audio signal using the non-harmonic bandwidth extension mode is provided and additionally a controller is implemented within the apparatus or a controlling step is implemented within a method for decoding for controlling the processor to decode the audio signal using the second non-harmonic bandwidth extension mode even when the bandwidth extension control data included in the encoded audio signal indicates the first—i.e. harmonic—bandwidth extension mode for the audio signal. Thus, the processor only has to be implemented with corresponding hardware resources such as memory and processing power to only cope with the computationally very efficient non-harmonic bandwidth extension mode. On the other hand, the audio decoder is nevertheless in the position to accept and decode an encoded audio signal necessitating a harmonic bandwidth extension mode with an acceptable quality. Stated differently, for low computational resource demanding applications, the controller is configured for controlling the processor to decode the whole audio signal with the non-harmonic bandwidth extension mode, even though the encoded audio signal itself necessitates, due to the included bandwidth extension control data, that at least several portions of this signal are decoded using the harmonic bandwidth extension mode. Thus, a good compromise between computational resources on the one hand and audio quality on the other hand is obtained, while the full backward compatibility is maintained to encoded audio signals necessitating both bandwidth extension modes. The present invention is advantageous due to the fact that it lowers the computational complexity and memory demand of particularly a USAC decoder. Furthermore, in embodiments, the predetermined or standardized non-harmonic bandwidth extension mode is modified using harmonic bandwidth extension mode data transmitted in the bitstream in order to reuse bandwidth extension mode data which are basically not necessary for the non-harmonic bandwidth extension mode as far as possible in order to even improve the audio quality of the non-harmonic bandwidth extension mode. Thus, an alternative decoding scheme is provided in this embodiment, in order to mitigate the impairment of perceptual quality caused by omitting the harmonic bandwidth extension mode which is typically based on phase-vocoder processing as discussed in the USAC standard [1].

In an embodiment, the processor has memory and processing resources being sufficient for decoding the encoded audio signal using the second non-harmonic bandwidth extension mode, wherein the memory or processing resources are not sufficient for decoding the encoded audio signal using the first harmonic bandwidth extension mode, when the encoded audio signal is an encoded stereo or multichannel audio signal. Contrary thereto the processor has memory and processing resources being sufficient for decoding the encoded audio signal using the second non-harmonic bandwidth extension mode and using the first harmonic bandwidth extension mode, when the encoded audio signal is an encoded mono signal, since the resources for mono decoding are reduced compared to the resources for stereo or multichannel decoding. Hence, the available resources depend on the bit-stream configuration, i.e. combination of tools, sampling rate etc. For example it may be possible that resources are sufficient to decode a mono bit-stream using harmonic BWE but the processor lacks resources to decode a stereo bit-stream using harmonic BWE.

BRIEF DESCRIPTION OF THE DRAWINGS

Embodiments of the present invention will be detailed subsequently referring to the appended drawings, in which:

FIG. 1*c* illustrates a table illustrating the USAC standard decoder and the novel decoder;

FIG. 6 illustrates a syntax of the decoding procedure for a single-channel element;

FIGS. 7*a* and 7*b* illustrate a syntax of the decoding procedure for a channel-pair element;

FIG. 8*b* illustrates a summary of the data indicated in FIG. 8*a*;

DETAILED DESCRIPTION OF THE INVENTION

Figure 1A:
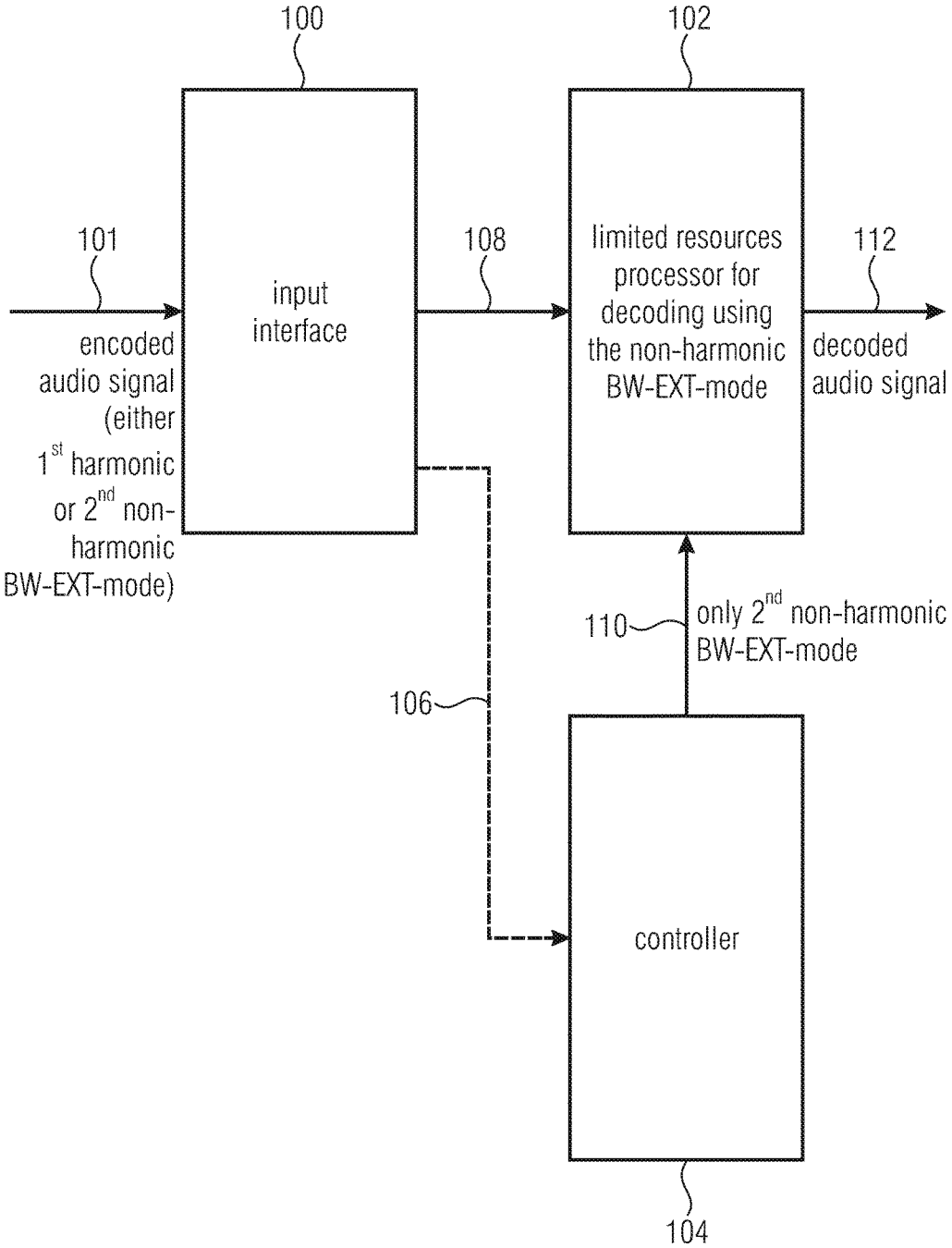
FIG. 1*a* illustrates an embodiment of an apparatus for decoding an encoded audio signal using a limited resources processor.

FIG. 1*a* illustrates an embodiment of an apparatus for decoding an encoded audio signal. The encoded audio signal comprises bandwidth extension control data indicating either a first harmonic bandwidth extension mode or a second non-harmonic bandwidth extension mode. The encoded audio signal is input on a line 101 into an input interface 100. The input interface is connected via line 108 to a limited resources processor 102. Furthermore, a controller 104 is provided which is at least optionally connected to the input interface 100 via line 106 and which is additionally connected to the processor 102 via line 110. The output of the processor 102 is a decoded audio signal as indicated at 112. The input interface 100 is configured for receiving the encoded audio signal comprising the bandwidth extension control data indicating either a first harmonic bandwidth extension mode or a second non-harmonic bandwidth extension mode for an encoded portion such as a frame of the encoded audio signal. The processor 102 is configured for decoding the audio signal using the second non-harmonic bandwidth extension mode only as indicated close to line 110 in FIG. 1*a*. This is made sure by the controller 104. The controller 104 is configured for controlling the processor 102 to decode the audio signal using the second non-harmonic bandwidth extension mode, even when the bandwidth extension control data indicate the first harmonic bandwidth extension mode for the encoded audio signal.

Figure 1B:
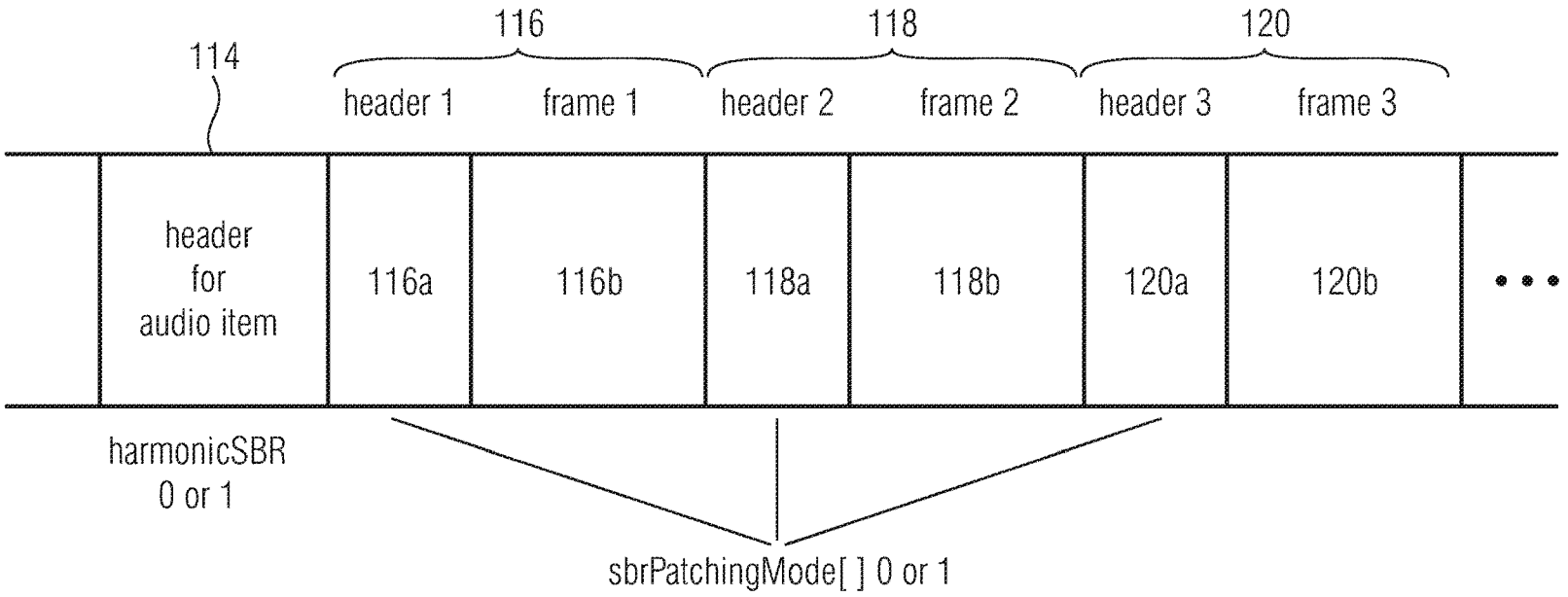
FIG. 1*b* illustrates an example of an encoded audio signal data for both bandwidth extension modes.

FIG. 1*b* illustrates an implementation of the encoded audio signal within a data stream or a bitstream. The encoded audio signal comprises a header 114 for the whole audio item, and the whole audio item is organized into serial frames such as frame 1 116, frame 2 118 and frame 3 120. Each frame additionally has an associated header, such as header 1 116*a* for frame 1 and payload data 116*b* for frame 1. Furthermore, the second frame 118 again has header data 118*a* and payload data 118*b*. Analogously, the third frame 120 again has a header 120*a* and a payload data block 120*b*. In the USAC standard, the header 114 has a flag "harmonicSBR". If this flag harmonicSBR is zero, then the whole audio item is decoded using a non-harmonic bandwidth extension mode as defined in the USAC standard, which in this context refers back to the High Efficiency—AAC standard (HE-AAC), which is ISO/IEC 1449-3:2009, audio part. However, if the harmonicSBR flag has a value of one, then the harmonic bandwidth extension mode is enabled, but can then be signaled, for each frame, by an individual flag sbrPatchingMode which can be zero or one. In this context, reference is made to FIG. 1*c* indicating the different values of the two flags. Thus, when the flag harmonicSBR is one and the flag sbrPatchingMode is zero, then the USAC standard decoder performs a harmonic bandwidth extension mode. In this case, which is indicated at 130 in FIG. 1*c*, however, the controller 104 of FIG. 1*a* is operative to nevertheless control the processor 102 to perform a non-harmonic bandwidth extension mode.

Figure 2:
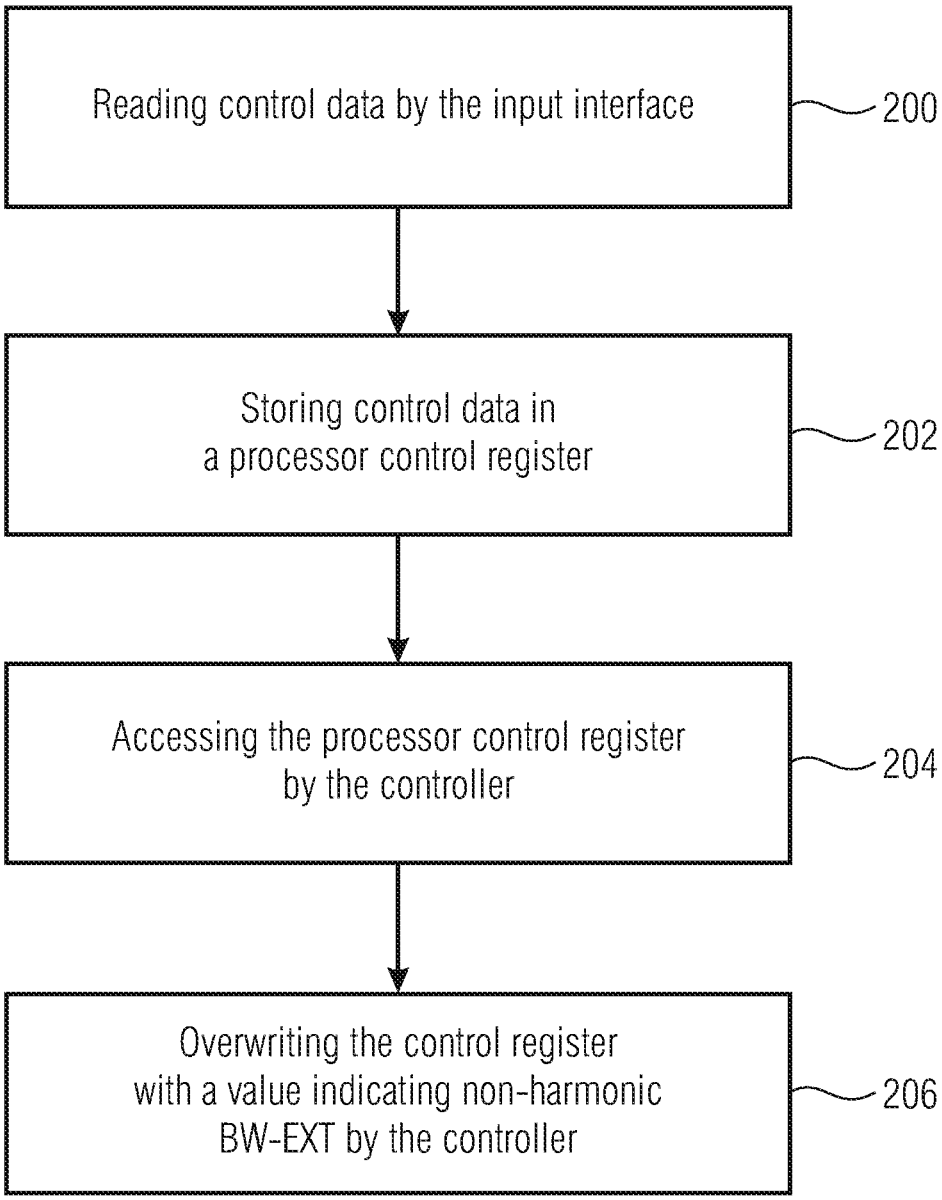
FIG. 2 illustrates a flowchart of an embodiment for implementing the controller of FIG. 1*a*.

FIG. 2 illustrates an implementation of the inventive procedure. In step 200, the input interface 100 or any other entity within the apparatus for decoding reads the bandwidth extension control data from the encoded audio signal, and this bandwidth extension control data can be one indication per frame or, if provided, an additional indication per item as discussed in the context of FIG. 1*b* with respect to the USAC standard. In step 202, the processor 102 receives the bandwidth extension control data and stores the bandwidth extension control data in a specific control register implemented within the processor 102 of FIG. 1*a*. Then, in step 204, the controller 104 accesses this processor control register and, as indicated at 206, overwrites the control register with a value indicating the non-harmonic bandwidth extension. This is exemplarily illustrated within the USAC syntax for the single-channel element at 600 in FIG. 6 or for the sbr_channel_pair_element indicated at step 700 in FIGS. 7*a* and 702, 704 in FIG. 7*b* respectively. In particular, the "overwriting" as illustrated in block 206 of FIG. 2 can be implemented by inserting the lines 600, 700, 702, 704 into the USAC syntax. In particular, the remainder of FIG. 6 corresponds to table 41 of ISO/IEC DIS 23003-3 and FIGS. 7*a*, 7*b* correspond to table 42 of ISO/IEC DIS 23003-3. This international standard is incorporated herewith in its entirety by reference. In the standard, a detailed definition of all the parameters/values in FIG. 6 and FIGS. 7*a*, 7*b* are a given.

In particular, the additional line in the high level syntax indicated at 600, 700, 702, 704 indicates that irrespective of the value sbrPatchingMode as read from the bitstream in 602, the sbrPatchingMode flag is nevertheless set to one, i.e. signaling, to the further process in the decoder, that a non-harmonic bandwidth extension mode is to be performed. Importantly, the syntax line 600 is placed subsequent to the decoder-side reading in of the specific harmonic bandwidth extension data consisting of sbrOversamplingFlag, sbrPitchInBinsFlag and sbrPitchInBins indicated at 604. Thus, as illustrated in FIG. 6, and analogously in FIG. 7*a*, the encoded audio signal comprises common bandwidth extension payload data 606 for both bandwidth extension modes, i.e. the non-harmonic bandwidth extension mode and the harmonic bandwidth extension mode, and additionally data specific for the harmonic bandwidth extension mode illustrated at 604. This will be discussed later in the context of FIG. 3*a*. The variable "IpHBE" illustrates the inventive procedure, i.e. the "low power harmonic bandwidth extension" mode which is a non-harmonic bandwidth extension mode, but with an additional modification which will be discussed later with respect to "the harmonic bandwidth extension".

Figure 3A:
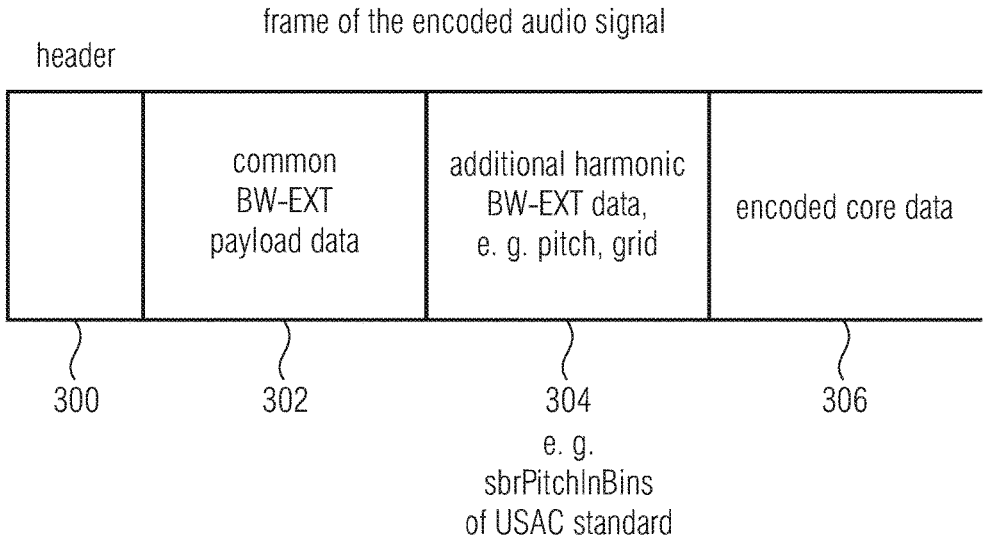
FIG. 3*a* illustrates a further structure of an encoded audio signal having common bandwidth extension payload data and additional harmonic bandwidth extension data.

As indicated in FIG. 1*a*, the processor 102 may be a limited resources processor. Specifically, the limited resources processor 102 has processing resources and memory resources being sufficient for decoding the audio signal using the second non-harmonic bandwidth extension mode. However, specifically the memory or the processing resources are not sufficient for decoding the encoded audio signal using the first harmonic bandwidth extension mode. As indicated in FIG. 3*a*, a frame comprises a header 300, a common bandwidth extension payload data 302, additional harmonic bandwidth extension data 304 such as information on a pitch, a harmonic grid or so, and additionally, encoded core data 306. The order of the data items can, however, be different from FIG. 3*a*. In a different embodiment, the encoded core data are first. Then, the header 300 having the sbrPatchingMode flag/bit comes followed by the additional HBE data 304 and finally the common BW extension data 302.

The additional harmonic bandwidth extension data is, in the USAC example, as discussed in the context of FIG. 6, item 604, the sbrPitchInBins information consisting of 7 bits.

Specifically, as indicated in the USAC standard, the data sbrPitchInBins controls the addition of cross-product terms in the SBR harmonic transposer. sbrPitchInBins is an integer value in the range between 0 and 127 and represents the distance measured in frequency bins for a 1536-DFT acting on the sampling frequency of the core coder. In particular, it has been found that using the sbrPitchInBins information, the pitch or harmonic grid can be determined. This is illustrated in the formula (1) in FIG. 8*b*. In order to calculate the harmonic grid, the values of sbrPitchInBins and sbrRatio are calculated where the SBR ratio can be as indicated in FIG. 8*b* above.

Figure 3B:
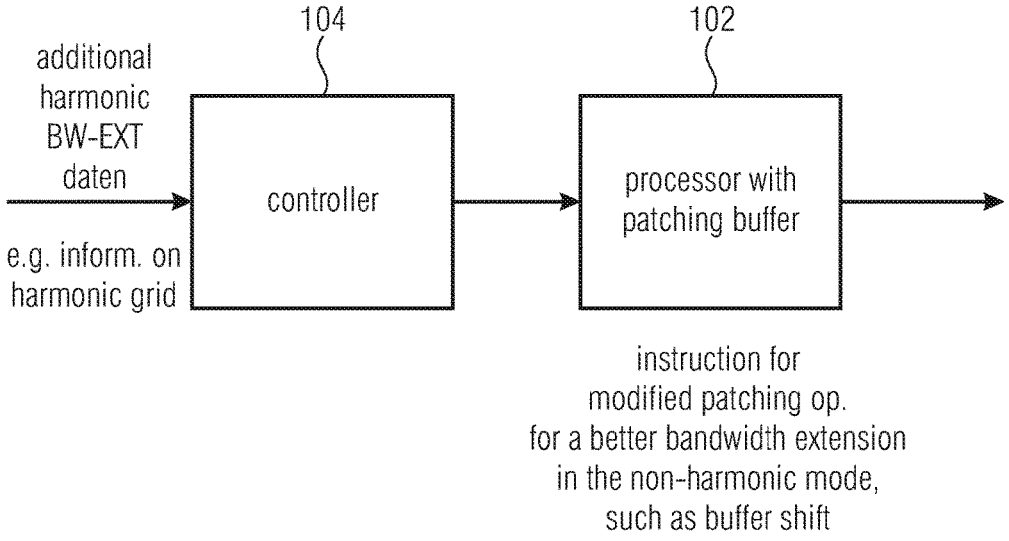
FIG. 3*b* illustrates an implementation of the controller for modifying the standard non-harmonic bandwidth extension mode.

Naturally, other indications of the harmonic grid, the pitch or the fundamental tone defining the harmonic grid can be included in the bitstream. This data is used for controlling the first harmonic bandwidth extension mode and can, in one embodiment of the present invention, be discarded so that the non-harmonic bandwidth extension mode without any modifications is performed. In other embodiments, however, the straightforward non-harmonic bandwidth extension mode is modified using the control data for the harmonic bandwidth extension mode as illustrated in FIG. 3*b* and other figures. In other words, the encoded audio signal comprises the common bandwidth extension payload data 302 for the first harmonic bandwidth extension and the second non-harmonic bandwidth extension mode and additional payload data 304 for the first harmonic bandwidth extension mode. In this context, the controller 104 illustrated in FIG. 1 is configured to use the additional payload data for controlling the processor 102 to modify a patching operation performed by the processor compared to a patching operation in the second non-harmonic bandwidth extension mode without any modification. To this end, it is advantageous that the processor 102 comprises a patching buffer as illustrated in FIG. 3*b*, and the specific implementation of the buffer is exemplarily explained with respect to FIG. 8*d*.

In the further embodiment, the additional payload data 304 for the first harmonic bandwidth extension mode comprises information on a harmonic characteristic of the encoded audio signal, and this harmonic characteristic can be sbrPitchInBins data, other harmonic grid data, fundamental tone data or any other data, from which a harmonic grid or a fundamental tone or a pitch of the corresponding portion of the encoded audio signal can be derived. The controller 104 is configured for modifying a patching buffer content of a patching buffer used by the processor 102 to perform a patching operation in decoding the encoded audio signal so that a harmonic characteristic of a patch signal is closer to the harmonic characteristic than a signal patched without modifying the patching buffer.

Figure 9:
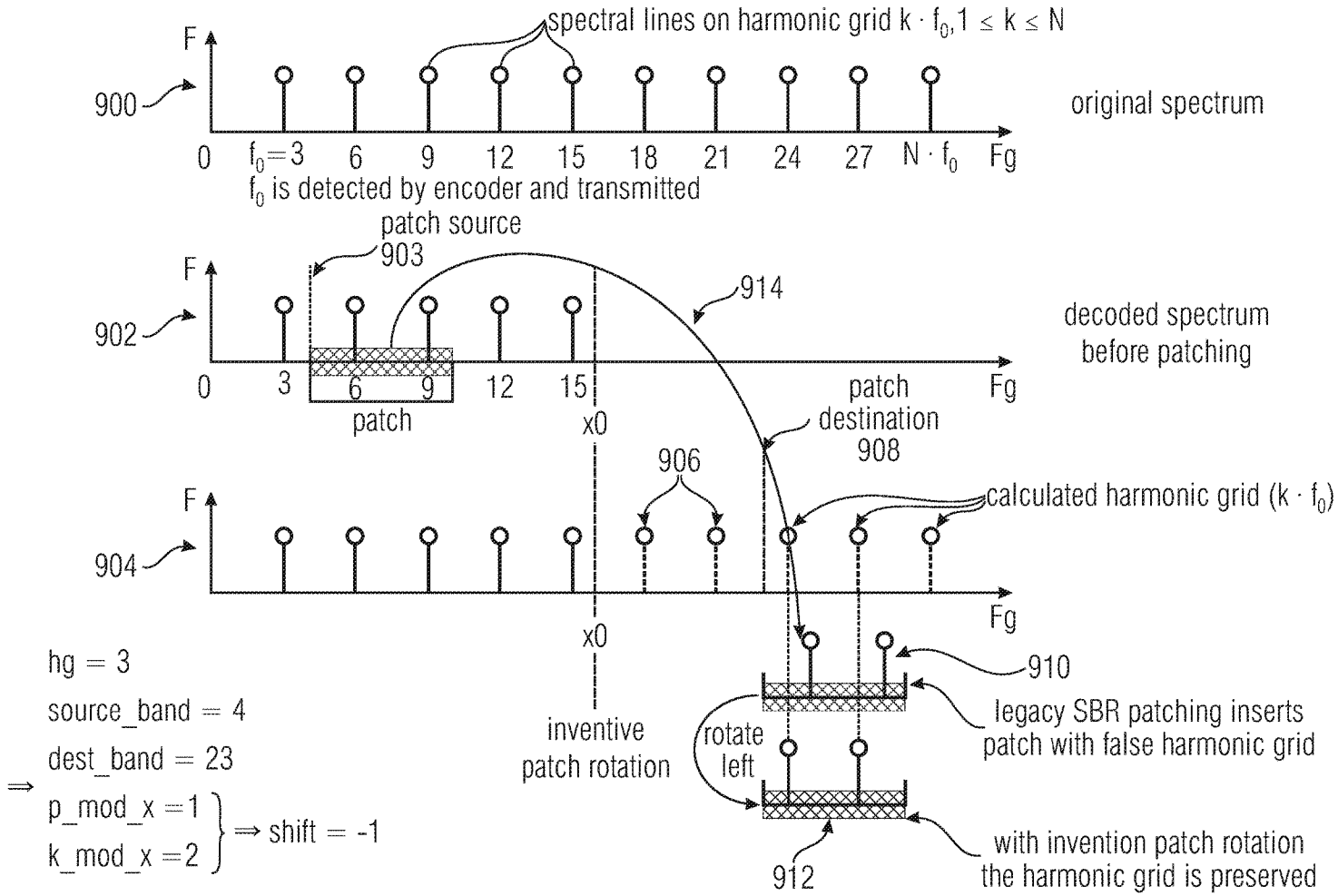
FIG. 9 illustrates an explanation of the modification of the non-harmonic bandwidth extension mode.

To this end, reference is made to FIG. 9 illustrating, at 900, an original spectrum having spectral lines on a harmonic grid $k \cdot f_0$ and the harmonic lines extend from 1 to N. Furthermore, the fundamental tone $f_0$ is, in this example, equal to 3 so that the harmonic grid comprises all multiples of 3. Furthermore, item 902 indicates a decoded core spectrum before patching. In particular, the crossover frequency x0 is indicated at 16 and a patch source is indicated to extend from frequency line 4 to frequency line 10. The patch source start and/or stop frequency may be signaled within the encoded audio signal typically as data within the common bandwidth extension payload data 302 of FIG. 3*a*. Item 904 indicates the same situation as in item 902, but with an additionally calculated harmonic grid $k \cdot f_0$ at 906. Furthermore, a patch destination 908 is indicated. This patch destination may additionally be included in the common bandwidth extension payload data 302 of FIG. 3*a*. Thus, the patch source indicates the lower frequency of the source range as indicated at 903 and the patch destination indicates the lower border of the patch destination. If the typically non-harmonic patching would be applied as indicated 910, then it would be seen that there would be a mismatch between the tonal lines or harmonic lines of the patched data and the calculated harmonic grid 906. Thus, the legacy SBR patching or the straightforward USAC or High Efficiency AAC non-harmonic patching mode inserts a patch with a false harmonic grid. In order to address this issue, the modification of this straightforward non-harmonic patch is performed by the processor. One way to modify is to rotate the content of the patching buffer or, stated differently, to move the harmonic lines within the patching band, but without changing the distance in frequency of the harmonic lines. Other ways to match the harmonic grid of the patch to the calculated harmonic grid of the decoded spectrum before patching are clear for those skilled in the art. In this embodiment of the present invention, the additional harmonic bandwidth extension data included in the encoded audio signal together with the common bandwidth extension payload data are not simply discarded, but are reused to even improve the audio quality by modifying the non-harmonic bandwidth extension mode typically signaled within the bitstream. Nevertheless, due to the fact that the modified non-harmonic bandwidth extension mode is still a non-harmonic bandwidth extension mode relying on a copy-up operation of a set of adjacent frequency bins into a set of adjacent frequency bins, this procedure does not result in an additional amount of memory resources compared to performing the straightforward non-harmonic bandwidth extension mode but significantly enhances audio quality of the reconstructed signal due to the matching harmonic grids as indicating in FIG. 9 at 912.

Figure 3C:
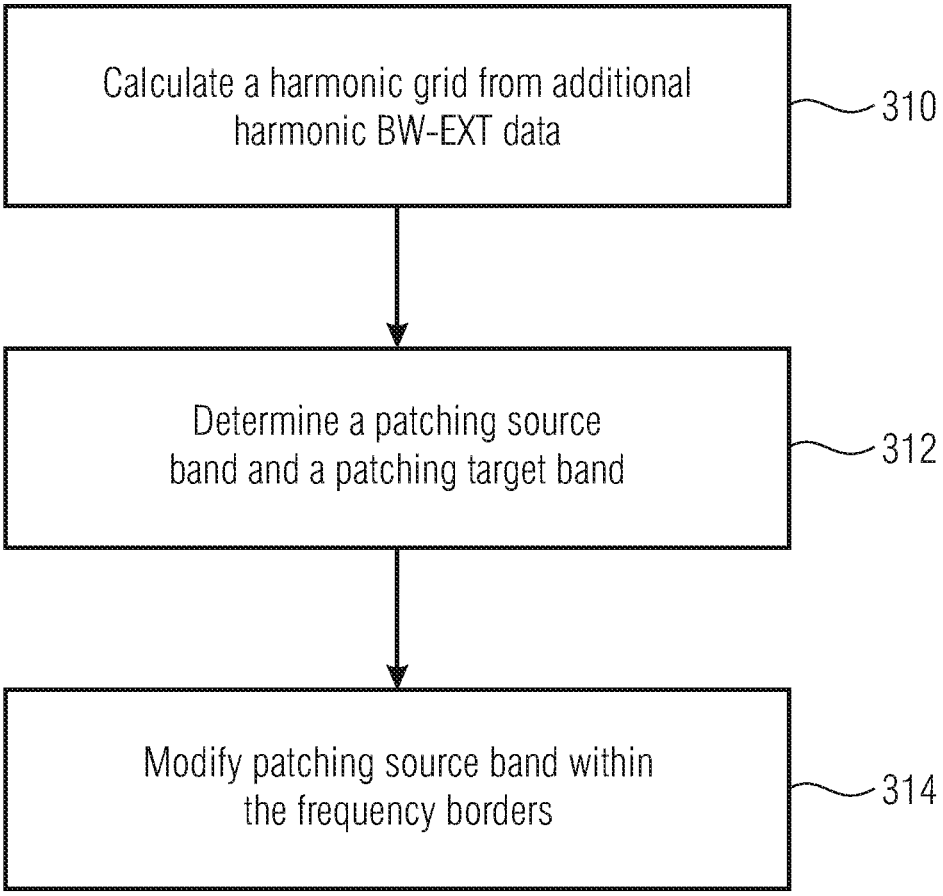
FIG. 3*c* illustrates a further implementation of the controller.

FIG. 3*c* illustrates an implementation performed by the controller 104 of FIG. 3*b*. In a step 310, the controller 104 calculates a harmonic grid from the additional harmonic bandwidth extension data and to this end, any calculation can be performed, but in the context of USAC the formula (1) in FIG. 8*b* is performed. Furthermore, in step 312, a patching source band and a patching target band are determined, i.e. this may comprise basically reading the patch source data 903 and the patch destination data 908 from the common bandwidth extension data. In other embodiments, however, this data can be predefined and therefore can already be known to the decoder and does not necessarily have to be transmitted.

In step 314, the patching source band is modified within the frequency borders, i.e. the patch borders of the patch source are not changed compared to the transmitted data. This can be done either before patching, i.e. when the patch data is with respect to the core or decoded spectrum before patching indicated at 902 or when the patch content has already been transposed into the higher frequency range, i.e. as illustrated in FIGS. 9 at 910 and 912, where the rotation is performed subsequent to patching, where patching is symbolized by arrow 914.

This patching 914 or "copy-up", is a non-harmonic patching which can be seen in FIG. 9 by comparing the broadness of the patch source comprising six frequency increments, and the same six frequency increments in the target range, i.e. at 910 or 912.

The modification is performed in such a way that a frequency portion in the patching source band coinciding with the harmonic grid is located, after patching, in a target frequency portion coinciding with the harmonic grid.

Figure 4:
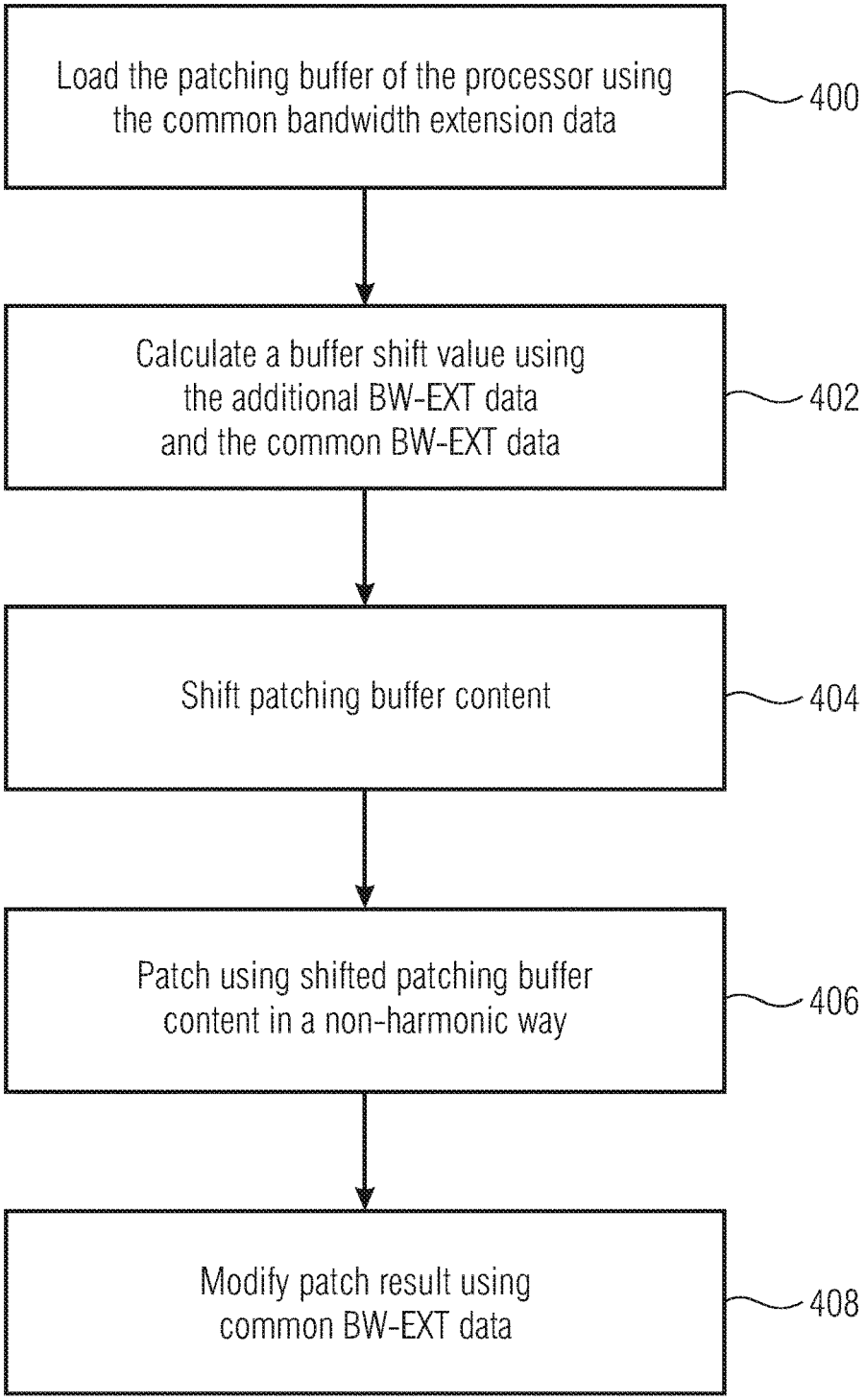
FIG. 4 illustrates an implementation of the improved non-harmonic bandwidth extension mode.
Figure 8A:
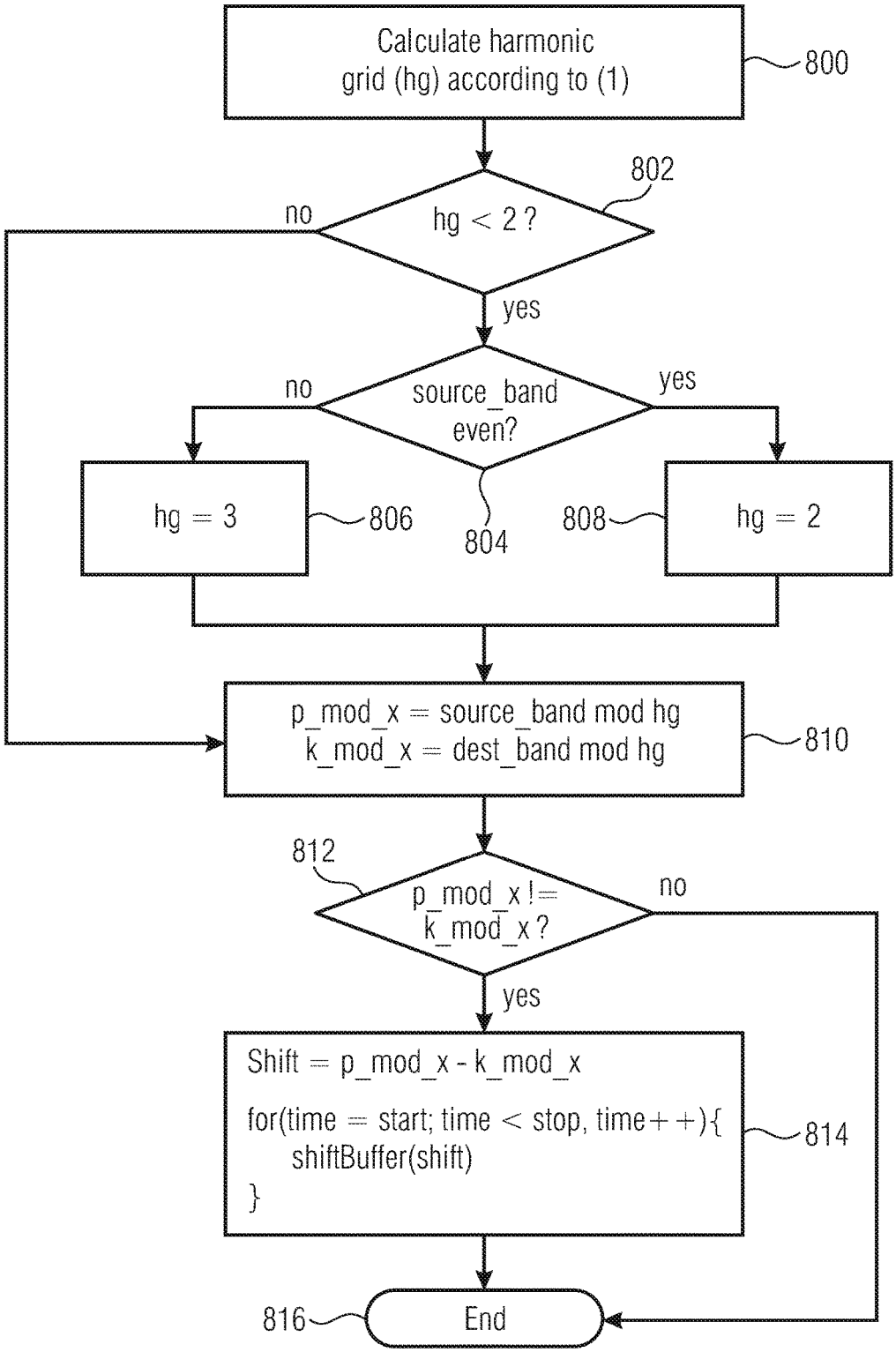
FIG. 8*a* illustrates a further implementation of the improvement non-harmonic bandwidth extension mode.
Figure 8C:
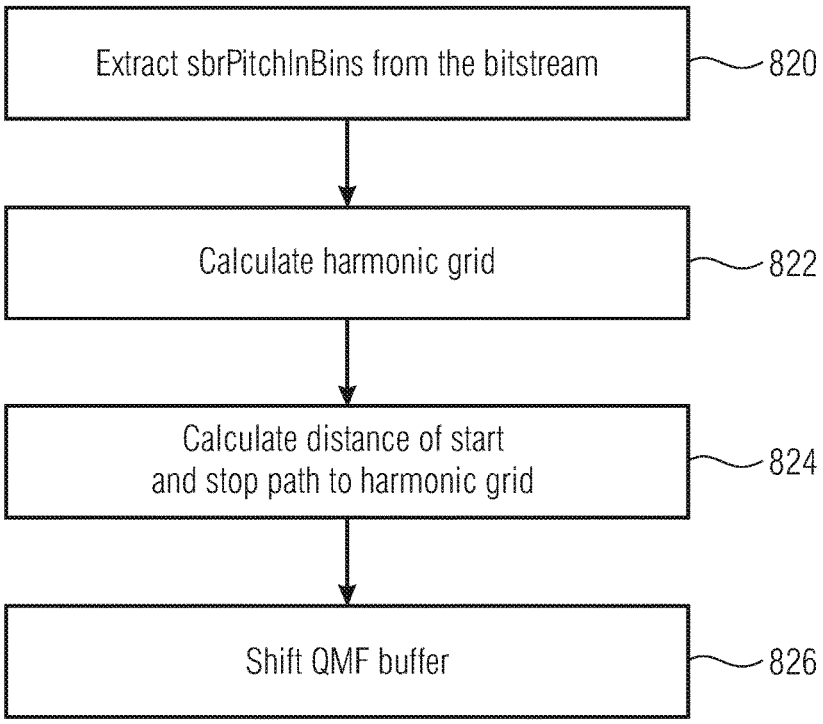
FIG. 8*c* illustrates a further implementation of the improvement of the non-harmonic bandwidth extension mode as performed by the controller.
Figure 8D:
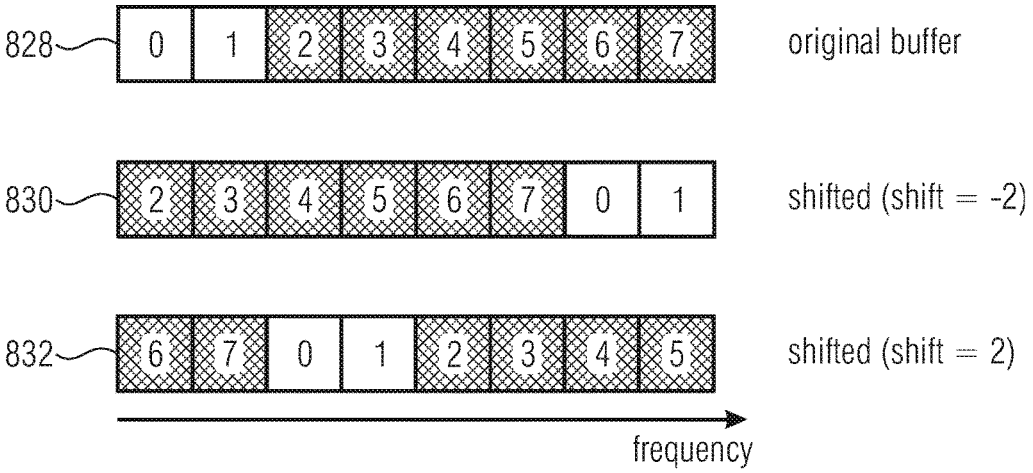
FIG. 8*d* illustrates a patching buffer and the shifting of the content of the patching buffer.

Preferably, as illustrated in FIG. 8*d*, the patching buffer indicated at three different states 828, 830, 832 is provided within the processor 102. The processor is configured to load the patching buffer as indicated at 400 in FIG. 4. Then, the controller is configured to calculate 402 a buffer shift value using the additional bandwidth extension data and the common bandwidth extension data. Then, in step 404, the buffer content is shifted by the calculated buffer shift value. Item 830 indicates when the shift value has been calculated to be "−2", and item 832 indicates a buffer state in which a shift value of 2 has been calculated in step 404 and a shift by +2 has been performed in step 404. Then, as illustrated in 406 of FIG. 4, a patching is performed using the shifted patching buffer content and the patch is nevertheless performed in a non-harmonic way. Then, in step 408, the patch result is modified using common bandwidth extension data. Such additionally used common extension bandwidth data can be, as known from High Efficiency AAC or from USAC, spectral envelope data, noise data, data on specific harmonic lines, inverse filtering data, etc.

Figure 5:
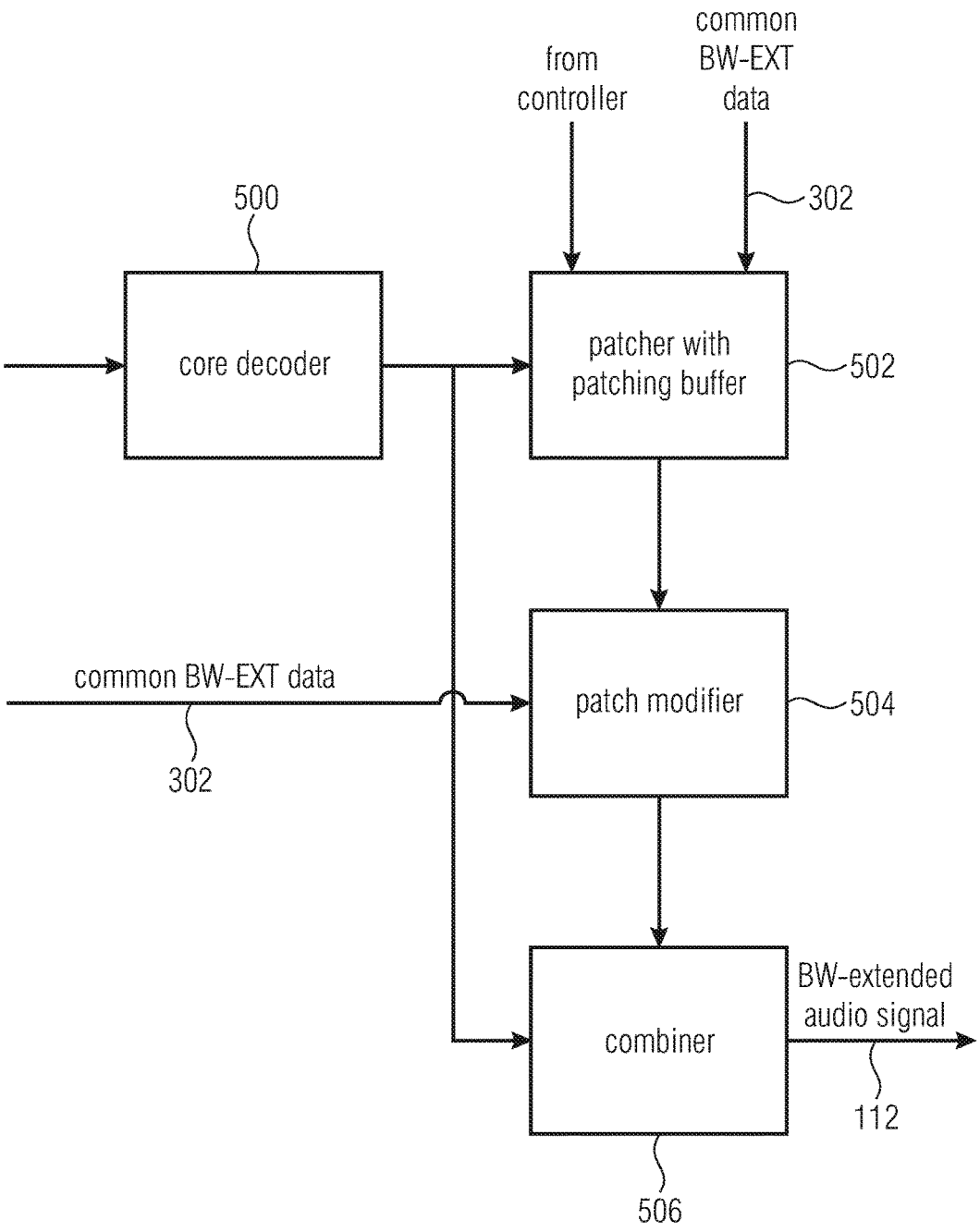
FIG. 5 illustrates an implementation of the processor.

To this end, reference is made to FIG. 5 illustrating a more detailed implementation of the processor 102 of FIG. 1*a*. The processor typically comprises a core decoder 500, a patcher 502 with the patching buffer, a patch modifier 504 and a combiner 506. The core decoder is configured to decode the encoded audio signal to obtain a decoded spectrum before patching as illustrated in 902 in FIG. 9. Then, the patcher with the patching buffer 502 performs the operation 914 in FIG. 9. The patcher 502 performs the modification of the patching buffer either before or after patching as discussed in the context of FIG. 9. The patch modifier 504 finally uses additional bandwidth extension data to modify the patch result as outlined at 408 in FIG. 4. Then, the combiner 506, which can be, for example, a frequency domain combiner in the form of a synthesis filterbank, combines the output of the patch modifier 504 and the output of the core decoder 500, i.e. the low band signal, in order to finally obtain the bandwidth extended audio signal as output at line 112 in FIG. 1*a*.

As already discussed in the context of FIG. 1*b*, the bandwidth extension control data may comprise a first control data entity for an audio item, such as harmonicSBR illustrated in FIG. 1*b*, where this audio item comprises a plurality of audio frames 116, 118, 120. The first control data entity indicates whether the first harmonic bandwidth extension mode is active or not for the plurality of frames. Furthermore, a second control data entity is provided corresponded to SBR patching mode exemplarily in the USAC standard which is provided in each of the headers 116*a*, 118*a*, 120*a* for the individual frames.

The input interface 100 of FIG. 1*a* is configured to read the first control data for the audio item and the second control data entity for each frame of the plurality of frames, and the controller 104 of FIG. 1*a* is configured for controlling the processor 102 to decode the audio signal using the second non-harmonic bandwidth extension mode irrespective of a value of the first control data entity and irrespective of a value of the second control data entity.

In an embodiment of the present invention, and as illustrated by the syntax changes in FIG. 6 and FIGS. 7*a*, 7*b*, the USAC decoder is forced to skip the relatively high complex harmonic bandwidth extension calculation. Thus, bandwidth extension or "low power HBE" is engaged, if the flag IpHBE indicated at 600 and 700, 702, 704 is set to a non-zero value. The IpHBE flag may be set by a decoder individually, depending on the available hardware resources. A zero value means the decoder will act fully standard compliant, i.e. as instructed by the first and second control data entities of FIG. 1*b*. However, if the value is one, then the non-harmonic bandwidth extension mode will be performed by the processor even when the harmonic bandwidth extension mode is signaled.

Thus, the present invention provides a lower computational complexity and lower memory consumption necessitating processor together with a new decoding procedure. The bitstream syntax of eSBR as defined in [1] shares a common base for both HBE [1] and legacy SBR decoding [2]. In case of HBE, however, additional information is encoded into the bitstream. The "low complexity HBE" decoder in an embodiment of the present invention decodes the USAC encoded data according to [1] and discards all HBE specific information. Remaining eSBR data is then fed to and interpreted by the legacy SBR [2] algorithm, i.e. the data is used to apply copy-up patching [2] instead of harmonic transposition. The modification of the eSBR decoding mechanics is, with respect to the syntax changes, illustrated in FIGS. 6 and 7*a*, 7*b*. Furthermore, in an embodiment, the specific HBE information such as sbrPitchInBins information carried by the bitstream is reused.

With legacy USAC encoded bitstream data the sbrPitchInBins value might be transmitted within a USAC frame. This value reflects a frequency value which was determined by an encoder to transmit information describing the harmonic structure of the current USAC frame. In order to exploit this value without using the standard HBE functionality, the following inventive method should be applied step by step:

1. Extract sbrPitchInBins from the bitstream
   See Table 44 and Table 45 respectively for information how to extract the bitstream element sbrPitchInBins from the USAC bitstream [1].
2. Calculate the harmonic grid according to Formula (1)

$$harmoincGrid = NINT\left(\left(\frac{64 * sbrPitchInBins * sbrRatio}{1536}\right)\right) \quad \text{Formula (1)}$$

3. Calculate distance of both source patch start sub-band and destination patch start sub-band to harmonic grid The flowchart in FIG. 8*a* gives a detailed description of the inventive algorithm how to calculate the distance of start and stop patch to the harmonic grid

| | |
|---|---|
| harmonicGrid (hg) | Harmonic grid according to (1) |
| source_band | QMF patch source band 903 of FIG. 9 |
| dest_band | QMF patch destination band 908 of FIG. 9 |
| p_mod_x | source_band mod hg |
| k_mod_x | dest_band mod hg |
| mod | Modulo operation |
| NINT | Round to nearest integer |
| sbrRatio | SBR ratio, i.e. ½, ⅜ or ¼ |
| pitchInBins | Pitch information transmitted in the bitstream |

Subsequently, FIG. 8*a* is discussed in more detail. This control, i.e. the whole calculation may be performed in the controller 104 of FIG. 1*a*. In step 800, the harmonic grid is calculated according to formula (1) as illustrated in FIG. 8*b*. Then, it is determined whether the harmonic grid hg is lower than 2. If this is not the case, then the control proceeds to step 810. When, however, it is determined that the harmonic grid is lower than 2, then step 804 determines whether the source-band value is even. If this is the case, then the harmonic grid is determined to be 2, but if this is not the case, then the harmonic grid is determined to be equal to 3. Then, in step 810, the modulo calculations are performed. In step 812, it is determined whether both modulo-calculation differ. If the results are identical, the procedure ends, and if the results differ, the shift value is calculated as indicated in block 814 as the difference between both mod-calculation results. Then, as also illustrated in step 814, the buffer shift with wraparound is performed. It is worth noting that phase relations may be considered when applying the shift. The control stops in block 816.

To summarize, as illustrated in FIG. 8*c*, the whole procedure comprises the step of extracting the sbrPitchInBins information from the bitstream as indicated at 820. Then, the controller calculates the harmonic grid as indicated at 822. Then, in step 824, both the distance of the source start sub-band and the destination start sub-band to the harmonic grid is calculated which corresponds, in the embodiment, to step 810. Finally, as indicated in block 826, the QMF buffer shift, i.e. the wraparound shift within the QMF domain of the High Efficiency AAC non-harmonic bandwidth extension is performed.

In the QMF buffer shift, the harmonic structure of the signal is reconstructed according to the transmitted sbrPitchInBins information even though a non-harmonic bandwidth extension procedure has been performed.

Although some aspects have been described in the context of an apparatus for encoding or decoding, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a non-transitory storage medium such as a digital storage medium, for example a floppy disc, a Hard Disk Drive (HDD), a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitory.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver .

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] ISO/IEC 23003-3:2012: "Unified speech and audio coding"

[2] ISO/IEC 14496-3:2009: "Audio"

[3] ISO/IEC JTCI/SC29/WG11 MPEG2011/N12232: "USAC Verification Test Report"

The invention claimed is:

1. An apparatus for decoding an encoded audio signal comprising bandwidth extension control data indicating either a first harmonic bandwidth extension mode or a second non-harmonic bandwidth extension mode, the apparatus comprising:

an input interface configured for receiving the encoded audio signal comprising the bandwidth extension control data indicating either the first harmonic bandwidth extension mode or the second non-harmonic bandwidth extension mode; and a processor configured for decoding the audio signal the audio signal using the second non-harmonic bandwidth extension mode, when the bandwidth extension control data indicates the second non-harmonic bandwidth extension mode, and also when the bandwidth extension control data indicates the first harmonic bandwidth extension mode for the encoded signal, wherein the processor comprises memory resources and processing resources being sufficient for decoding the encoded audio signal using the second non-harmonic bandwidth extension mode, wherein the memory resources or the processing resources are not sufficient for decoding the encoded audio signal using the first harmonic bandwidth extension mode, when the encoded audio signal is an encoded stereo or multichannel audio signal, and wherein the memory resources and the processing resources of the processor are sufficient for decoding the encoded audio signal using the second non-harmonic bandwidth extension mode and using the first harmonic bandwidth extension mode, when the encoded audio signal is an encoded mono signal.

2. The apparatus of claim 1, wherein the processor comprises memory resources and processing resources being sufficient for decoding the encoded audio signal using the second non-harmonic bandwidth extension mode, wherein the memory resources or the processing resources are not sufficient for decoding the encoded audio signal using the first harmonic bandwidth extension mode.

3. The apparatus of claim 1, wherein the input interface is configured for reading the bandwidth extension control data to determine, whether the encoded audio signal is to be decoded using either the first harmonic bandwidth extension mode or the second non-harmonic bandwidth extension mode and to store the bandwidth extension control data in a processor control register, and wherein the apparatus further comprises a controller being configured to access the processor control register and to overwrite a value in the processor control register by a value indicating the second non-harmonic bandwidth extension mode, when the input interface has stored a value indicating the first harmonic bandwidth extension mode.

4. The apparatus of claim 1, wherein the encoded audio signal comprises common bandwidth extension payload data for the first harmonic bandwidth extension mode and the second non-harmonic bandwidth extension mode and additional payload data for the first harmonic bandwidth extension mode only, and wherein apparatus further comprises a controller being configured to use the additional payload data for controlling the processor to modify a patching operation performed by the processor compared to a patching operation in the second non-harmonic bandwidth extension mode, wherein the modified patching operation is a non-harmonic patching operation.

5. The apparatus in accordance with claim 1, wherein the processor comprises:

a core decoder for decoding a core encoded audio signal;

a patcher for patching a source frequency region of a core decoded audio signal to a target frequency region using bandwidth extension data from the encoded audio signal in accordance with the non-harmonic bandwidth extension mode; and a patch modifier for modifying a patched signal in the target frequency region using the bandwidth extension data from the encoded audio signal.

6. The apparatus in accordance with claim 1, wherein the encoded audio signal is a bitstream as defined by the USAC standard, wherein the processor is configured to perform the second non-harmonic bandwidth extension mode as defined by the USAC standard, and wherein the input interface is configured to parse the bitstream comprising the encoded audio signal in accordance with the USAC standard.

7. A method of decoding an encoded audio signal comprising bandwidth extension control data indicating either a first harmonic bandwidth extension mode or a second non-harmonic bandwidth extension mode, the method comprising:

receiving the encoded audio signal comprising the bandwidth extension control data indicating either the first harmonic bandwidth extension mode or the second non-harmonic bandwidth extension mode;

decoding, by a processor, the audio signal using the second non-harmonic bandwidth extension mode, when the bandwidth extension control data indicates the second non-harmonic bandwidth extension mode, and also when the bandwidth extension control data indicates the first harmonic bandwidth extension mode for the encoded signal, wherein the processor comprises memory resources and processing resources being sufficient for decoding the encoded audio signal using the second non-harmonic bandwidth extension mode, wherein the memory resources or the processing resources are not sufficient for decoding the encoded audio signal using the first harmonic bandwidth extension mode, when the encoded audio signal is an encoded stereo or multi-channel audio signal, and wherein the memory resources and the processing resources of the processor are sufficient for decoding the encoded audio signal using the second non-harmonic bandwidth extension mode and using the first harmonic bandwidth extension mode, when the encoded audio signal is an encoded mono signal.

8. A non-transitory digital storage medium having a computer program stored thereon to perform, when said computer program is run by a computer, the method of decoding an encoded audio comprising bandwidth extension control data indicating either a first harmonic bandwidth extension mode or a second non-harmonic bandwidth extension mode, the method comprising:

receiving the encoded audio signal comprising the bandwidth extension control data indicating either the first harmonic bandwidth extension mode or the second non-harmonic bandwidth extension mode;

decoding, by a processor, the audio signal using the second non-harmonic bandwidth extension mode, when the bandwidth extension control data indicates the second non-harmonic bandwidth extension mode, and also when the bandwidth extension control data indicates the first harmonic bandwidth extension mode for the encoded signal, wherein the processor comprises memory resources and processing resources being sufficient for decoding the encoded audio signal using the second non-harmonic bandwidth extension mode, wherein the memory resources or the processing resources are not sufficient for decoding the encoded audio signal using the first harmonic bandwidth extension mode, when the encoded audio signal is an encoded stereo or multi-channel audio signal, and wherein the memory resources and the processing resources of the processor are sufficient for decoding the encoded audio signal using the second non-harmonic bandwidth extension mode and using the first harmonic bandwidth extension mode, when the encoded audio signal is an encoded mono signal.

* * * * *